US011549251B2

(12) United States Patent
Lindholm

(10) Patent No.: US 11,549,251 B2
(45) Date of Patent: Jan. 10, 2023

(54) FOOT PEDAL

(71) Applicant: Sean Lindholm, Circle Pines, MN (US)

(72) Inventor: Sean Lindholm, Circle Pines, MN (US)

( * ) Notice: Subject to any disclaimer, the term of this patent is extended or adjusted under 35 U.S.C. 154(b) by 0 days.

(21) Appl. No.: 17/319,755

(22) Filed: May 13, 2021

(65) Prior Publication Data

US 2022/0364346 A1 Nov. 17, 2022

(51) Int. Cl.
*E03D 5/08* (2006.01)

(52) U.S. Cl.
CPC ..... *E03D 5/08* (2013.01)

(58) Field of Classification Search
CPC .... E03D 5/08; E03D 5/09; E03D 5/10; E03D 1/34
USPC ..... 4/249
See application file for complete search history.

(56) References Cited

U.S. PATENT DOCUMENTS 2,467,019 A * 4/1949 Farson ..... E03D 5/08 4/249
4,868,931 A * 9/1989 Schneeweiss ..... E03D 5/08 251/295
5,068,925 A * 12/1991 Salibi ..... E03D 5/08 4/405
5,142,708 A * 9/1992 Johnson ..... E03D 5/08 4/249
5,802,626 A * 9/1998 Bedana ..... E03D 5/08 4/308
6,035,457 A * 3/2000 Krause, Jr. ..... E03D 5/09 4/405
6,089,542 A * 7/2000 Caravella ..... F16K 31/465 251/294
6,115,851 A * 9/2000 Maseruka ..... E03D 5/02 4/405
7,302,713 B1 * 12/2007 Bhatt ..... G05G 1/42 251/295
2008/0072371 A1 * 3/2008 Rogers ..... E03D 5/09 4/405

OTHER PUBLICATIONS

Home Depot (https://www.homedepot.com/p/Rust-Oleum-Stops-Rust-12-oz-Textured-Metallic-Silver-Protective-Spray-Paint-251053/202531527); Aug. 7, 2020 (Year: 2020).*
Rust-Oleum (https://www.rustoleum.com/product-catalog/consumer-brands/stops-rust/bright-coat-spray?ls=7715830&lc=Aluminum); May 27, 2017 (Year: 2017).*

* cited by examiner

*Primary Examiner* — Benjamin R Shaw
(74) *Attorney, Agent, or Firm* — Vidas, Arrett & Steinkraus PA; Richard A. Arrett; Edwin E. Voigt, II

(57) ABSTRACT

A metal foot pedal for converting a hand flushing toilet to a foot flushing toilet, having a foot shaped plate with an attachment device secured to the foot shaped plate for attaching the foot shaped plate to a hand lever of a toilet, whereby the toilet can be flushed by foot.

5 Claims, 15 Drawing Sheets

FOOT PEDAL

CROSS-REFERENCE TO RELATED APPLICATIONS

Not Applicable

STATEMENT REGARDING FEDERALLY SPONSORED RESEARCH

Not Applicable

FIELD OF THE INVENTION

The invention relates to a foot pedal which is designed to be attached to an existing hand flush toilet to allow it to be flushed by foot, rather than by hand.

BACKGROUND OF THE INVENTION

The Covid-19 pandemic has made people more aware of hand transfer and germs, and therefore people would like to be able to flush public toilets without touching the flush handle with their hands.

BRIEF SUMMARY OF THE INVENTION

In the simplest form, the invention is a foot shaped metal plate which is secured to the flush hand lever, to allow the foot shaped plate to be pushed by a foot, to flush the toilet.

An alternative embodiment is also disclosed which provides a valve body and valve lever which are designed to fit over a flush lever

DETAILED DESCRIPTION OF THE INVENTION

Figure 1:
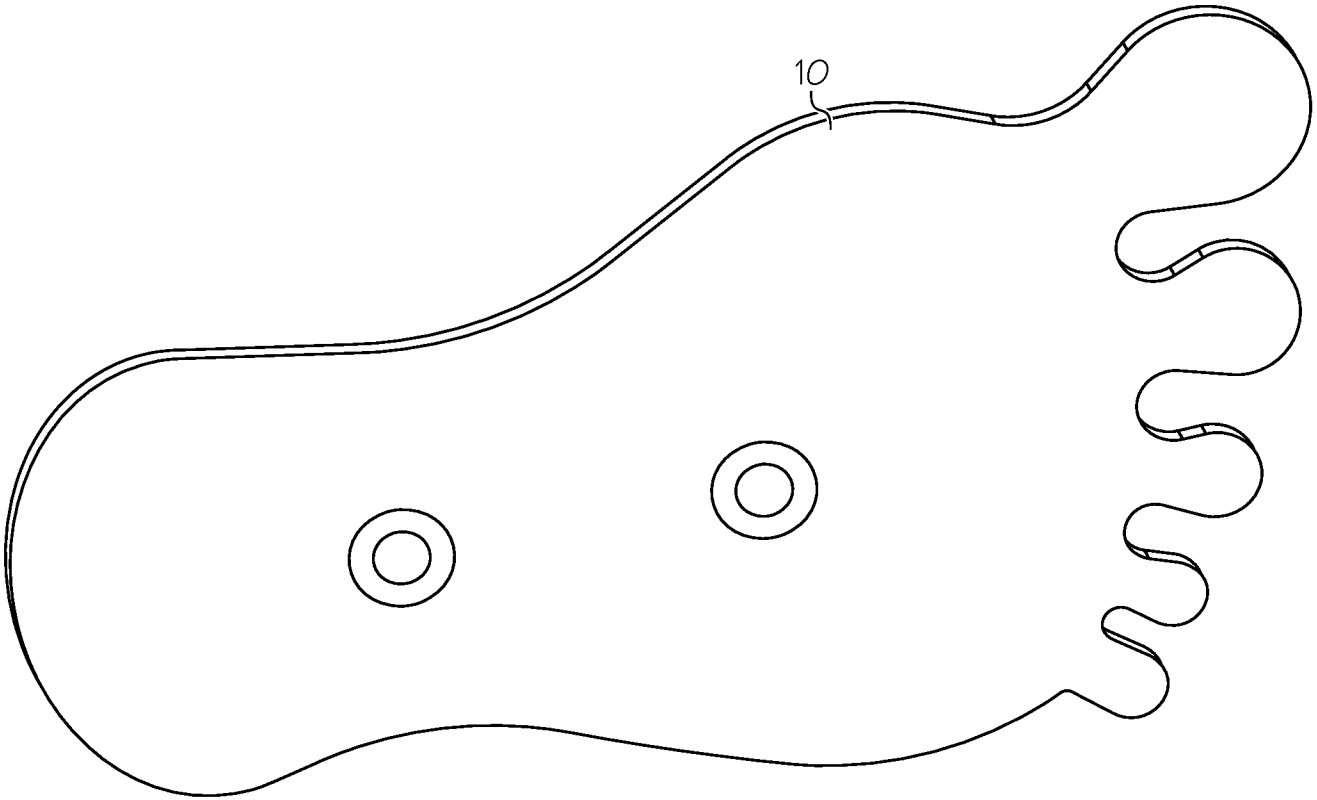
FIG. 1 shows the side of the inventive foot pedal which is pressed by the foot to flush a toilet.

While this invention may be embodied in many forms, there are described in detail herein specific embodiments of the invention. This description is an exemplification of the principles of the invention and is not intended to limit the invention to the particular embodiments illustrated.

For the purposes of this disclosure, like reference numerals in the figures shall refer to like features unless otherwise indicated.

FIG. 1 shows the side of the inventive foot pedal 10 (also referred to as a foot plate) which is pressed by the foot to flush a toilet.

Figure 2:
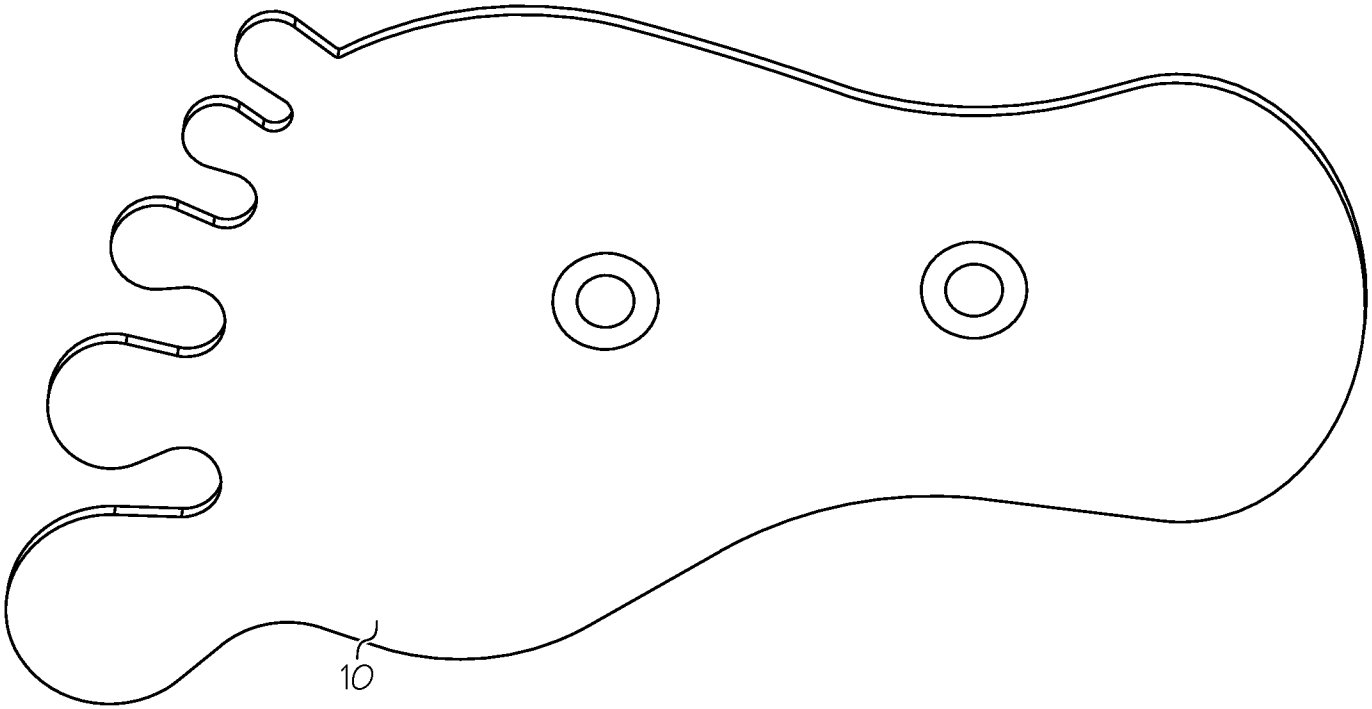
FIG. 2 shows another view of the inventive foot pedal side.

FIG. 2 shows another view of the inventive foot pedal side 10.

Figure 3:
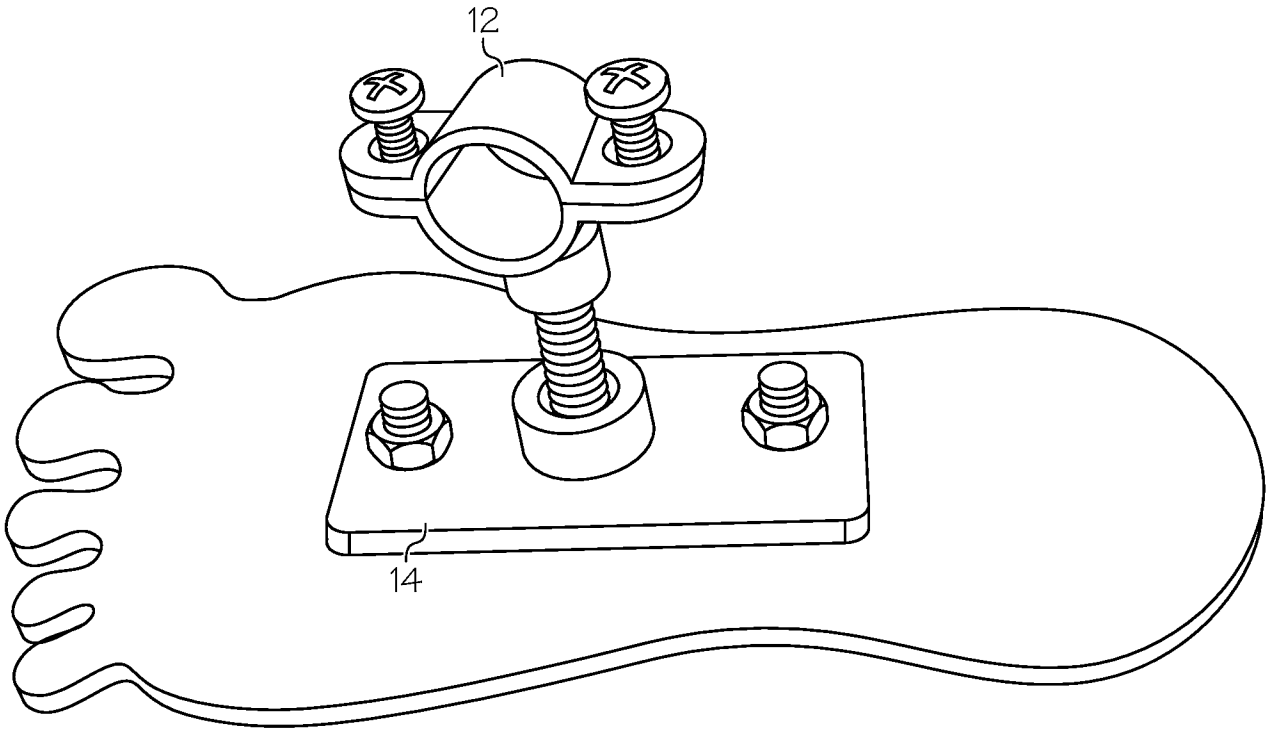
FIG. 3 shows the clamp which is connected to the foot pedal or plate and which is used to removably secure the foot pedal to the hand lever of a toilet.

FIG. 3 shows the clamp 12 which is connected to the foot pedal or plate at 14 and which is used to removably secure the foot pedal to the hand lever of a toilet.

Figure 4:
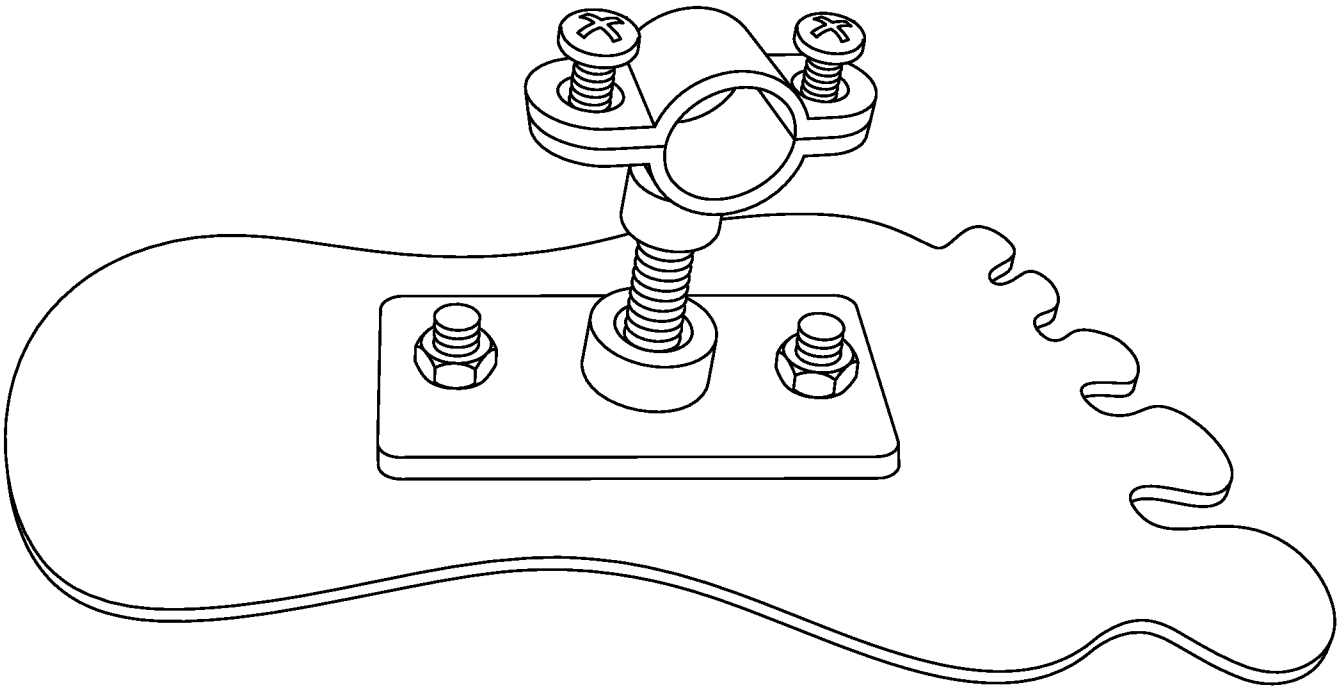
FIG. 4 shows another view of the attachment device.

FIG. 4 shows another view of the attachment device.

Figure 5:
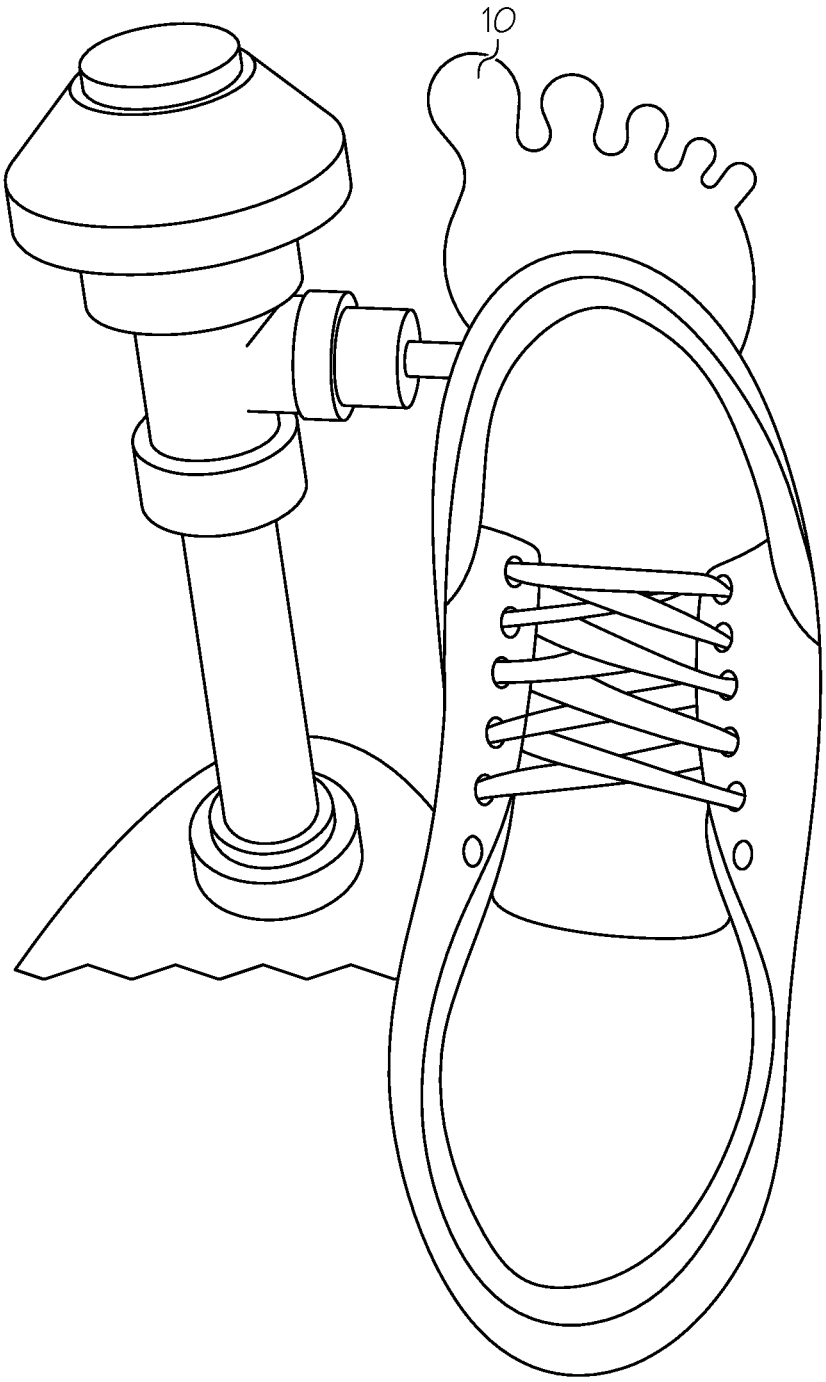
FIG. 5 shows the inventive foot pedal attached to a hand lever, with a foot pressing the foot pedal to flush the toilet.

FIG. 5 shows the inventive foot pedal attached to a hand lever, with a foot pressing the foot pedal to flush the toilet.

Figure 6:
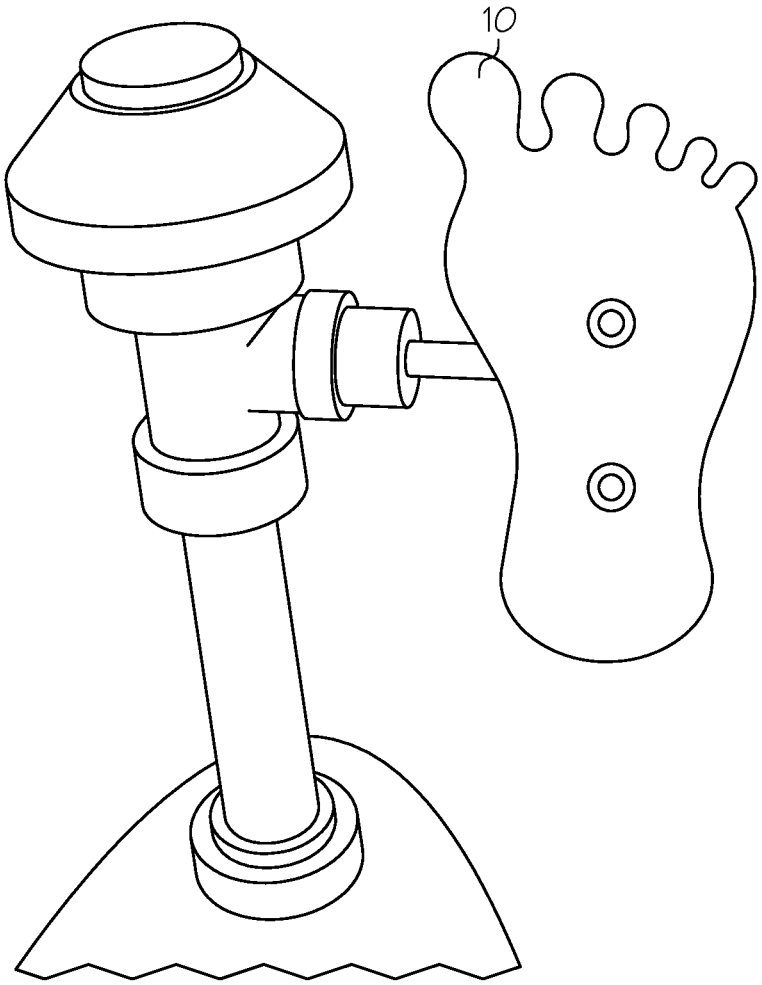
FIG. 6 shows a different view of the inventive foot pedal attached to a hand lever.

FIG. 6 shows a different view of the inventive foot pedal attached to a hand lever.

In operation, the metal foot bracket apparatus 10 with mounting mechanism 12 is attached to a hand lever commercial toilet. Foot bracket 10 has center counter sink holes drilled for rear mounting. 2 flush mount screws ¼-20×¾ FH TORX are used to attach front foot metal plate 10 to a ⅜" coated ceiling plate 14. The footplate 10 is painted with textured metallic paint, parts are painted with metallic aluminum paint. The texture provides a non-slip surface to push against.

The plate 10 and ceiling plate 14 are connected to the hand flush lever, making sure to rotate the plate 10 towards the front of the toilet, for ease of access for flushing.

Figure 7:
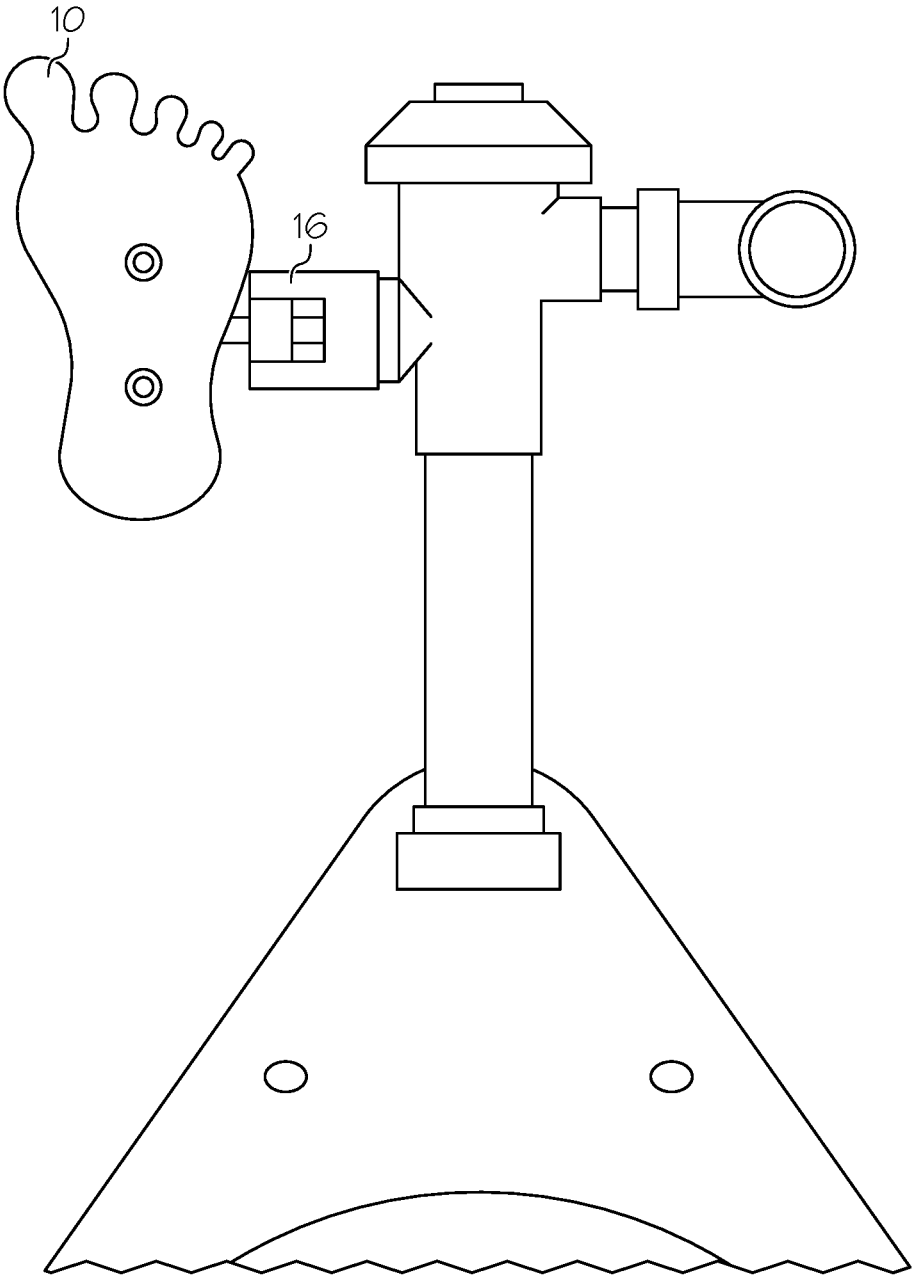
FIG. 7 shows a second embodiment of the invention with a valve body and valve lever connected to the toilet over the hand flush lever.

FIG. 7 shows a second embodiment of the invention with a valve body 16 and valve lever connected to the toilet over the hand flush lever.

Figure 8:
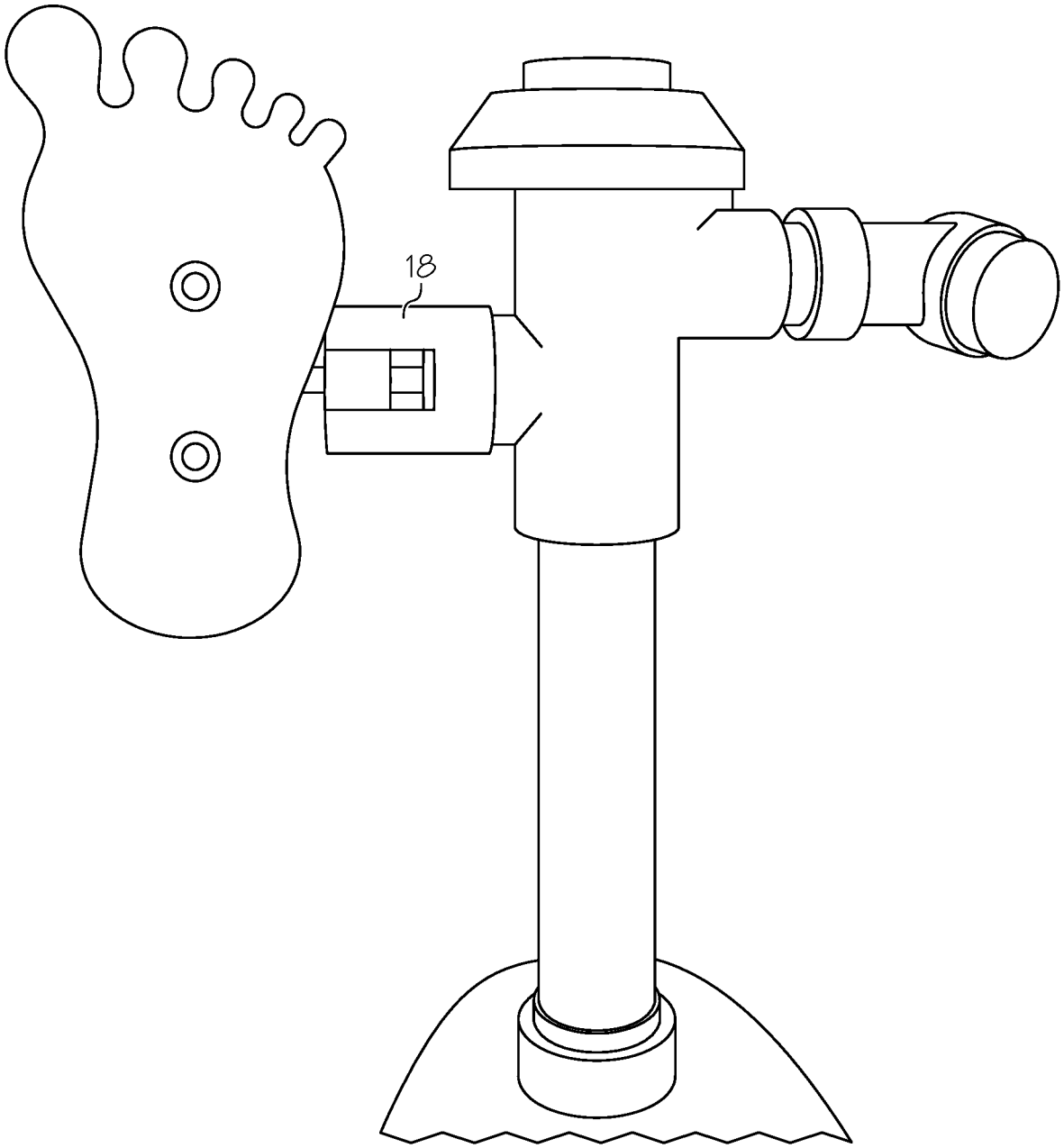
FIG. 8 shows another view of FIG. 7.

FIG. 8 shows another view of FIG. 7 which shows the valve lever 18 in more detail.

Figure 9:
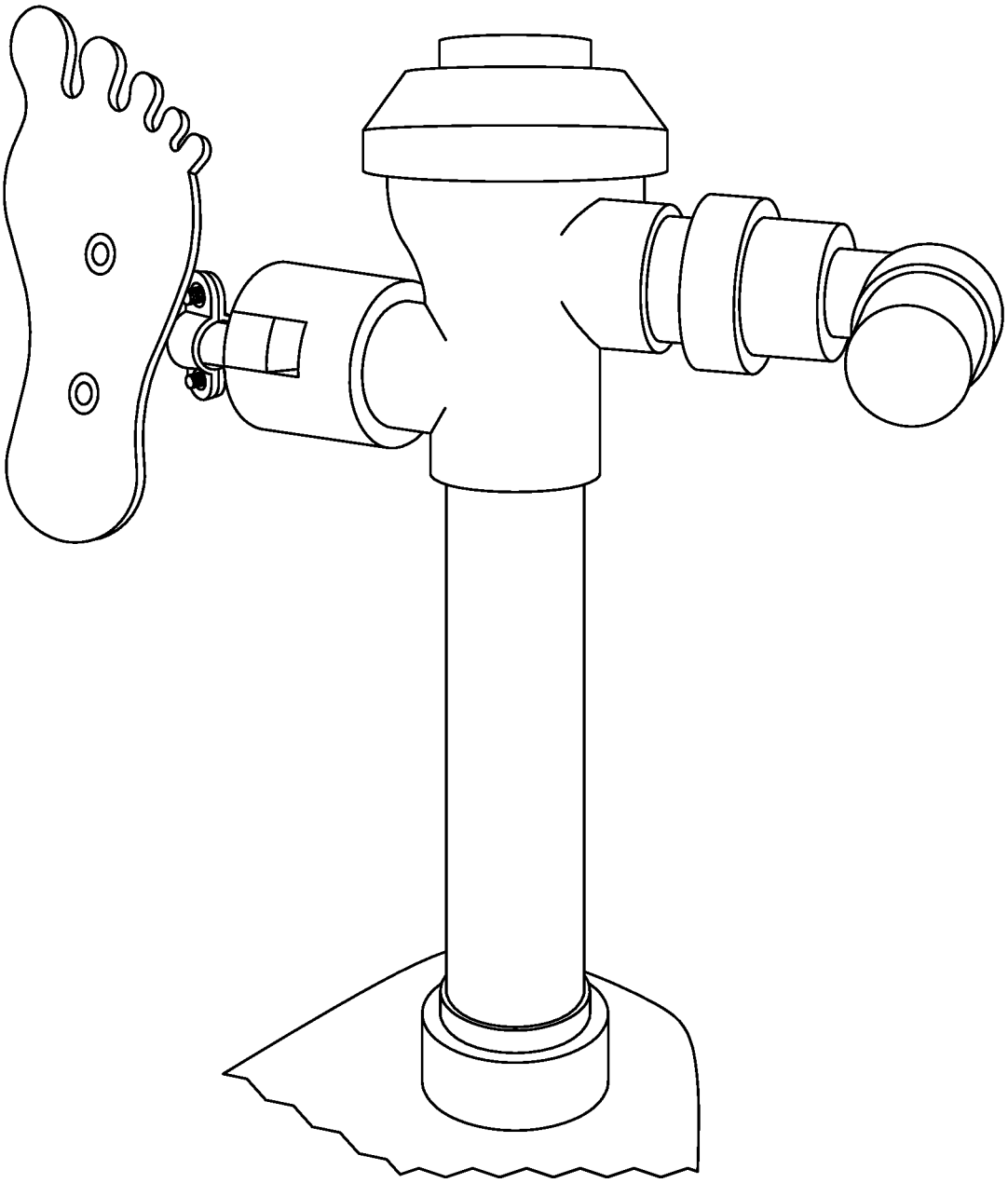
FIG. 9 shows another view of FIG. 7.

FIG. 9 shows another view of FIG. 7.

Figure 10:
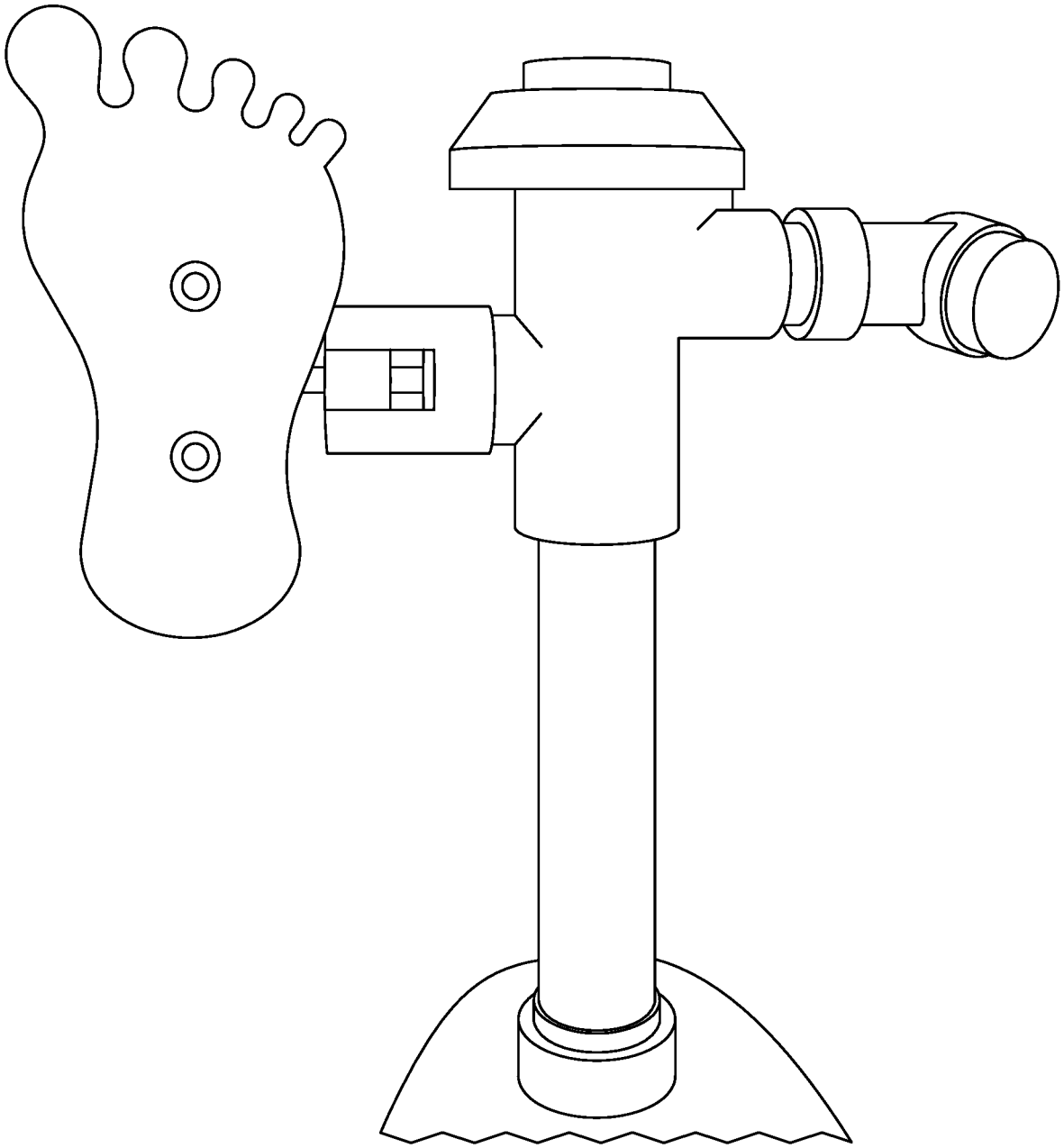
FIG. 10 shows another view of FIG. 7.

FIG. 10 shows another view of FIG. 7.

Figure 11:
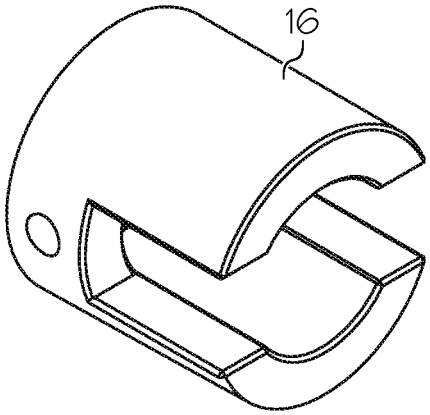
FIG. 11 shows a schematic view of the valve body.

FIG. 11 shows a schematic view of the valve body.

Figure 12:
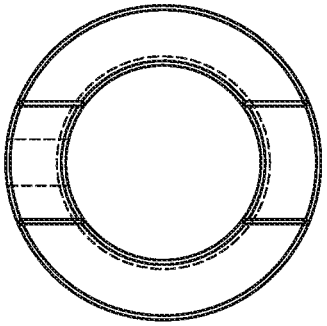
FIG. 12 shows a top view of FIG. 11, with a cross section taken at lines A-A.

FIG. 12 shows a top view of FIG. 11, with a cross section taken at lines A-A.

Figure 13:
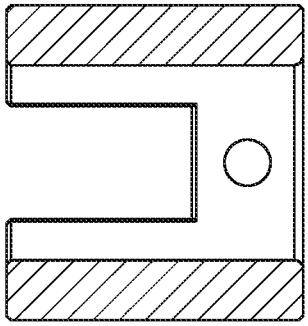
FIG. 13 shows the cross-section view of FIG. 12, taken at lines A-A.

FIG. 13 shows the cross-section view of FIG. 12, taken at lines A-A.

Figure 14:
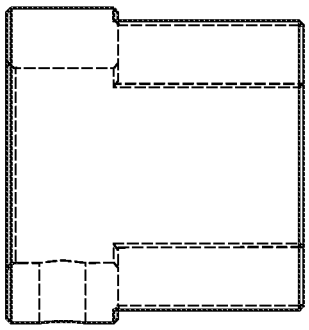
FIG. 14 shows the dimensions of one side of the valve body.

FIG. 14 shows the dimensions of one side of the valve body.

Figure 15:
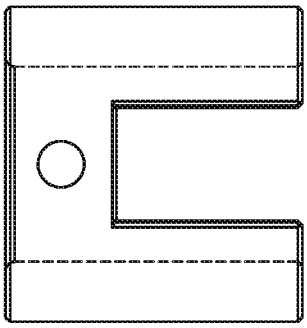
FIG. 15 shows the dimensions of another side of the valve body.

FIG. 15 shows the dimensions of another side of the valve body.

Figure 16:
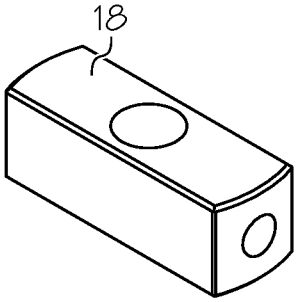
FIG. 16 shows a perspective view of the valve lever.

FIG. 16 shows a perspective view of the valve lever.

Figure 17:
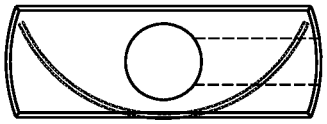
FIG. 17 shows a front view of FIG. 16.

FIG. 17 shows a front view of FIG. 16.

Figure 18:
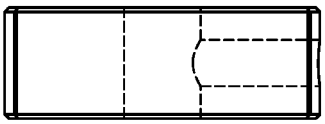
FIG. 18 shows the dimensions of the through hole which allows the lever to fit over the hand flush lever of a toilet.

FIG. 18 shows the dimensions of the through hole which allows the lever to fit over the hand flush lever of a toilet.

Figure 19:
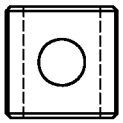
FIG. 19 shows the dimensions of the tap which is used to secure the valve lever to the hand flush lever.

FIG. 19 shows the dimensions of the tap which is used to secure the valve lever to the hand flush lever.

Figure 20:
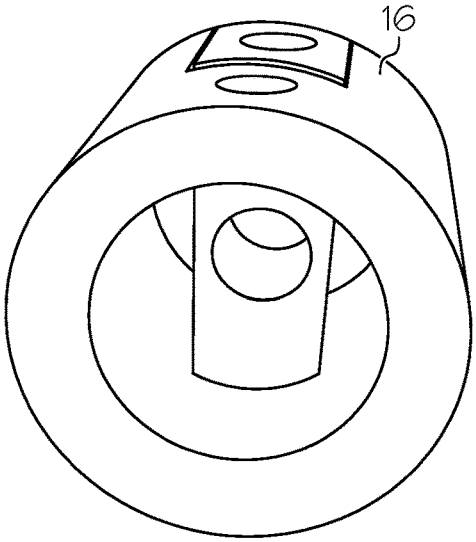
FIG. 20 shows an end view of the valve body.

FIG. 20 shows an end view of the valve body.

Figure 21:
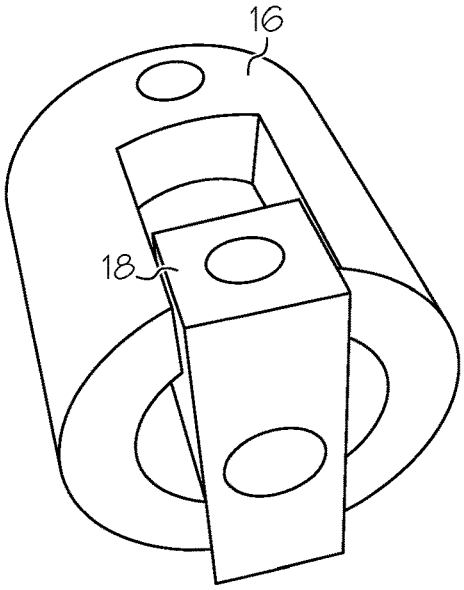
FIG. 21 shows the other end of the valve body and valve lever.

FIG. 21 shows the other end of the valve body and valve lever.

Figure 22:
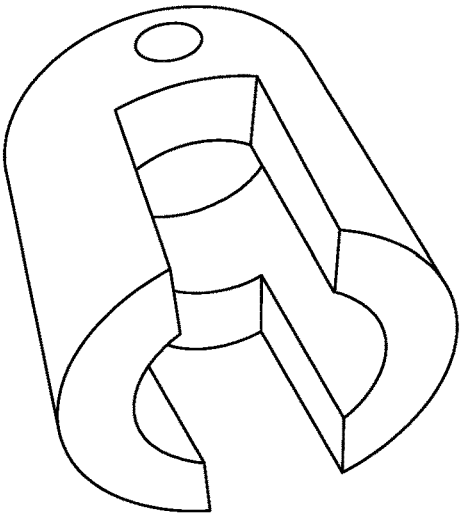
FIG. 22 shows shows a perspective view of the valve body.

FIG. 22 shows a perspective view of the valve body.

Figure 23:
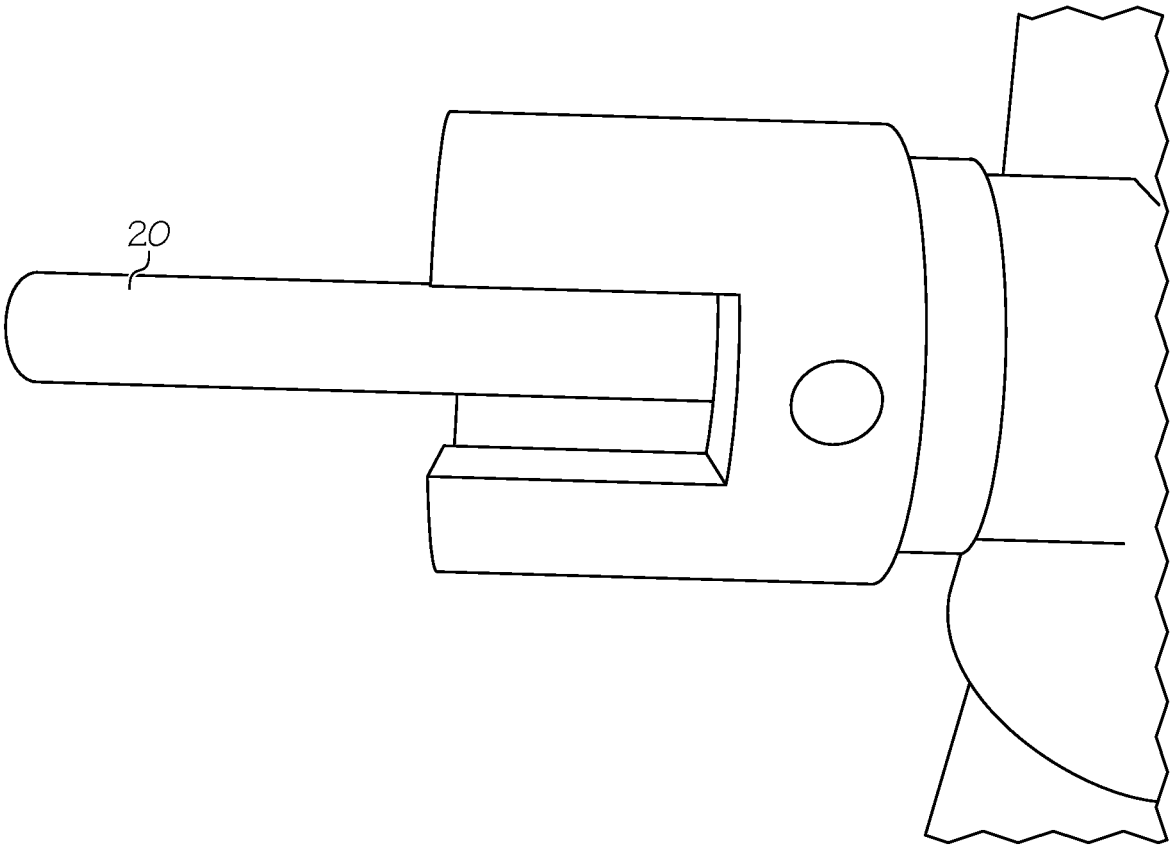
FIG. 23 shows the valve body mounted over the hand flush lever and secured to the toilet with a set screw.

FIG. 23 shows the valve body mounted over the hand flush lever and secured to the toilet with a set screw.

Figure 24:
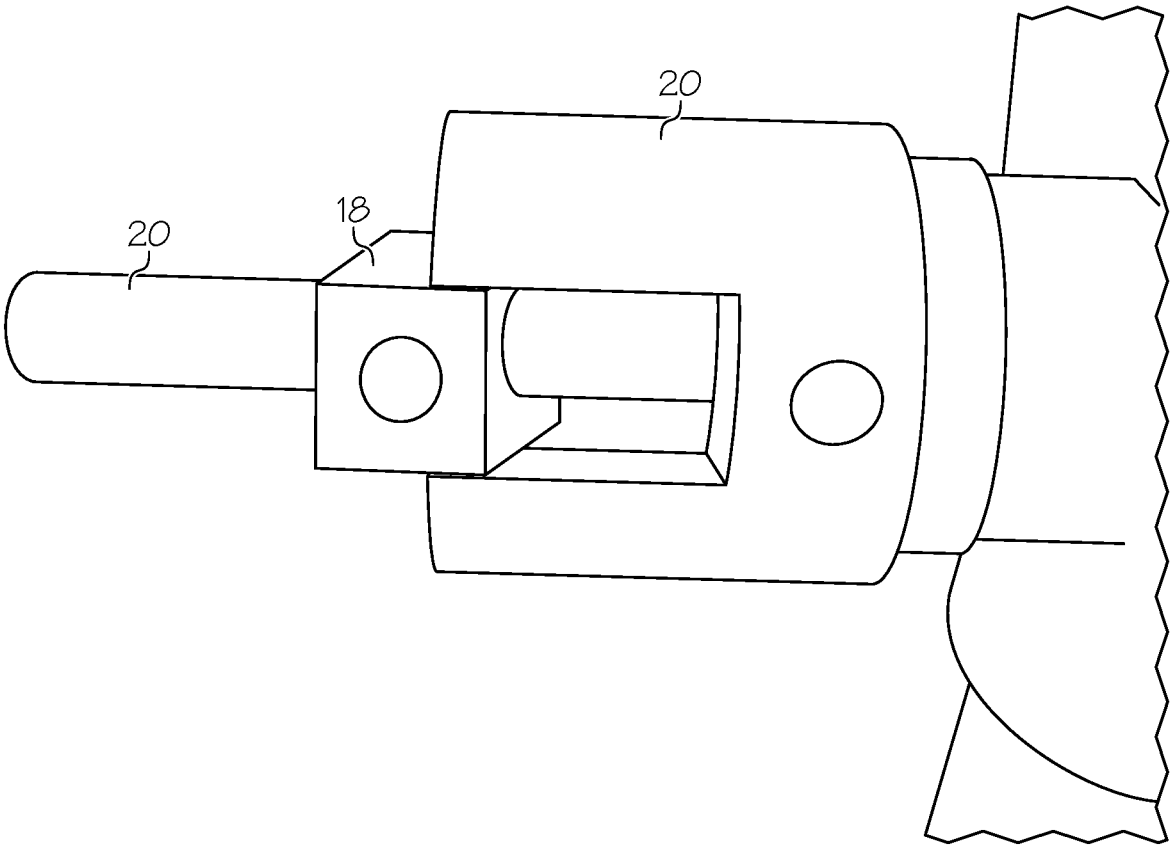
FIG. 24 shows the valve lever slide over the hand flush lever prior to being secured to the valve body.

FIG. 24 shows the valve lever 18 slide over the hand flush lever 20 prior to being secured to the valve body 16.

What is claimed is:

1. A foot pedal for converting a hand flushing toilet to a foot flushing toilet, comprising:

a valve body constructed and arranged to be connected to a toilet around a toilet tank lever;

a valve lever which slides over the toilet tank lever and is connected to the valve body, and which is movable relative to the valve body to move the toilet tank lever to flush the toilet;

a foot shaped plate;

an attachment device secured to the foot shaped plate which is attached to the toilet tank lever whereby the toilet can be flushed depressing the foot shaped plate with a foot.

2. The foot pedal of claim 1 wherein the foot shaped plate is connected to a clamp which is removably connected to the flush lever.

3. The metal foot pedal for converting a hand flushing toilet to a foot flushing toilet of claim 1 wherein the foot shaped plate is made of metal.

4. The metal foot pedal for converting a hand flushing toilet to a foot flushing toilet of claim 1 wherein the foot shaped plate is painted with textured paint to provide a non-slip surface to push against.

5. The metal foot pedal for converting a hand flushing toilet to a foot flushing toilet of claim 4 wherein the textured paint is aluminum paint.

* * * * *